US005238120A

United States Patent [19]

Ballestrazzi et al.

[11] Patent Number: 5,238,120

[45] Date of Patent: Aug. 24, 1993

[54] MACHINE FOR SORTING GRAPHIC AND/OR PRINTING PRODUCTS

[75] Inventors: Aris Ballestrazzi; Lamberto Tassi, both of Savignano sul Panaro, Italy

[73] Assignee: Sitma S.p.A., Spilamberto, Italy

[21] Appl. No.: 679,281

[22] Filed: Apr. 2, 1991

[30] Foreign Application Priority Data

Apr. 3, 1990 [IT] Italy ..... 19931 A/90

[51] Int. Cl.[5] ..... B07C 3/06

[52] U.S. Cl. ..... 209/539; 198/735.003; 198/418.009; 209/552; 209/583; 209/698; 209/900; 209/914; 209/925; 271/5; 271/6; 271/100; 271/298; 271/302; 414/790.003; 414/790.007

[58] Field of Search ..... 209/539, 540, 552, 583, 209/584, 569, 651, 653, 654, 698, 911, 914, 917, 912, 922, 925, 900; 198/735.3, 405, 369, 418.9, 418.8; 271/5, 6, 7, 99, 100, 104, 106, 12, 225, 298, 302, 213, 216; 414/790.3, 790.7, 794.3

[56] References Cited

U.S. PATENT DOCUMENTS

| | | | |
|---|---|---|---|
| 3,636,828 | 1/1972 | Achelpohl | 298/418.9 |
| 3,674,143 | 7/1972 | Hunter et al. . | |
| 3,970,202 | 7/1976 | Speggiorin et al. | 414/790.7 X |
| 4,042,113 | 8/1977 | Duncan et al. . | |
| 4,171,744 | 10/1979 | Hubbard | 209/900 X |
| 4,569,620 | 2/1986 | Lynch | 414/790.3 X |
| 4,627,540 | 12/1986 | Takeda | 209/900 X |
| 4,688,678 | 8/1987 | Zue et al. | 209/698 X |
| 4,717,015 | 1/1988 | Waller | 198/735.3 |
| 4,756,399 | 7/1988 | Scata | 209/698 X |
| 4,838,435 | 6/1989 | Alexandre et al. | 209/914 X |
| 4,963,251 | 10/1990 | Böhm et al. | 209/900 X |

FOREIGN PATENT DOCUMENTS

| | | | |
|---|---|---|---|
| 369418 | 12/1913 | Fed. Rep. of Germany | 271/100 |
| 2181523 | 12/1973 | France . | |

*Primary Examiner*—Donald T. Hajec

*Attorney, Agent, or Firm*—Hedman, Gibson & Costigan

[57] ABSTRACT

A machine for sorting graphic and/or printing products in which the products are fed one after the other, comprising a framework, a conveyor for receiving individual products one after the other sensors for identifying each of the individual products on the receiving conveyor a central computer, a control console for the entry of predetermined data, selectively actuated elements for unloading the products from the receiving conveyor and at least one conveyor for discharging the unloaded products, wherein the receiving conveyor consists of a sliding surface and is disposed on the framework inclined at an angle of between 10° and 90° with respect to the horizontal plane, the sliding surface having a lower end edge for containing the products and being provided with at least one longitudinal channel in which pusher elements are slidably guided, and wherein an intermediate belt conveyor is associated with an end portion of the receiving conveyor, the intermediate belt conveyor being inclined and aligned with the receiving conveyor at one end and at the other end being horizontal and aligned with the discharge conveyor, wherein at least two collecting conveyors are moreover associated with the discharge conveyor and can be operatively and selectively connected thereto by means of deflector elements, also actuated selectively in accordance with a predetermined sequence controlled by a computer.

19 Claims, 5 Drawing Sheets

MACHINE FOR SORTING GRAPHIC AND/OR PRINTING PRODUCTS

BACKGROUND OF THE INVENTION

This invention relates to a machine for sorting graphic and/or printing products.

Devices and machines forming bundles of newspapers, magazines, books or signatures of a predetermined number so that the bundles can then be dispatched for distribution are known in the printing industry. However, devices of this kind have significant limits with respect to the manual handling of the said products and they are not capable of effecting automatic sorting of the products in question.

The above considerations apply firstly in the phase consisting of forming bundles of graphic and/or printing products consisting of products of different types and adapted to be delivered to the distributor.

However, the inherent limits of the devices and machines of the known type are revealed above all with respect to the automatic handling of what are referred to as "returns" sent back to the distributor or directly to the publisher.

These returns are simply the copies of newspapers, magazines, books, etc. which have not been sold and are returned by the vendor to the distributor or to the publisher. These copies must be counted, principally to ascertain and verify the actual number sold and distributed by the said vendor. Secondly, it is useful to ascertain this number in order to determine the appropriate number of copies to send subsequently to the distributor and/or the vendor for attempted sale. The operational disadvantages of the machines of the known type consist above all of the difficulty in handling graphic and/or printing products of different sizes with respect to both section and height and of the difficulty in identifying some of these products which are different from one another, although at first sight are completely alike.

The object of this invention is to produce a machine which is capable of sorting graphic and/or printing products which may or may not be different, and of forming groups of products of a predetermined number, and of identifying and counting these products which may or may not be different.

Another object is to produce a machine of the type just mentioned with which both automatic and semi-automatic feeding devices for products of this kind can be associated.

SUMMARY OF THE INVENTION

One of the main objects is therefore to produce a machine which is capable of combining with this sorting control and direction of the products, a function which is useful both for the publisher and the final vendor. This problem is solved according to this invention by the production of a machine for sorting graphic and/or printing products in which the said products are fed one after the other, comprising a framework, a conveyor means for receiving individual products one after the other, sensor means for identifying each of the said products on the said receiving conveyor means, a central computer, a control console for the entry of predetermined data, selectively actuated intermediate conveyor means for unloading the said products from the said receiving conveyor means and at least one conveyor for discharging the said unloaded products, characterized in that the said receiving conveyor means consists of a sliding surface and is disposed on the said framework inclined at an angle of between 10° and 90° with respect to the horizontal plane, that the said sliding surface has a lower end edge for containing the said products and is provided with at least one longitudinal channel in which pusher elements are slidably guided, that an intermediate belt conveyor is associated with an end portion of the said receiving conveyor means, said intermediate belt conveyor being inclined and aligned with the said receiving conveyor means at one end and at the other end being horizontal and aligned with the said discharge conveyor, wherein at least two collecting conveyors are moreover associated with the said discharge conveyor and can be operatively and selectively connected thereto by means of deflector elements, also actuated selectively in accordance with a predetermined sequence controlled by the said computer.

The characteristics, features and advantages of a machine according to this invention will be more readily understood from the following description given by way of a non-limiting example and with reference to the accompanying drawings, in which:

DESCRIPTION OF THE PREFERRED EMBODIMENTS

Figure 1:
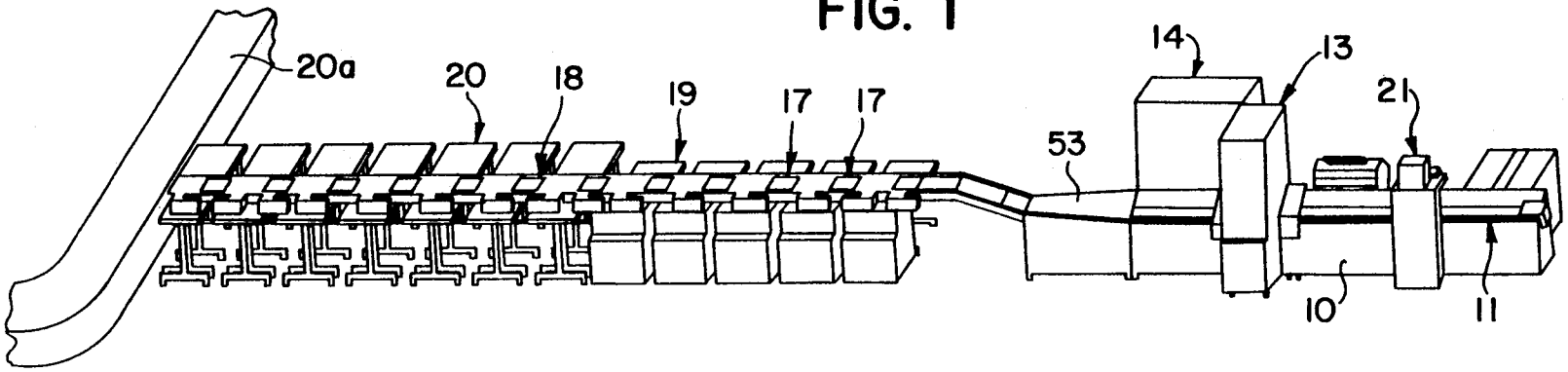
FIG. 1 is a diagrammatic perspective view of the machine according to this invention.

Referring to FIG. 1, it shows a machine for sorting graphic and/or printing products according to this invention, in its entirety.

The machine of FIG. 1 essentially comprises a framework 10 consisting of various parts that can be coupled together, a conveyor means 11 for receiving individual graphic and/or printing products of different sizes designated respectively by 12*a*, 12*b*, 12*c*, etc., a detector unit 13 disposed in correspondence with the receiving conveyor means 11, a central computer 14, a set of discharge and unloading means designated 17 and 18, and finally underlying collecting conveyor means 19 and 20 or end belt means 20*a* of the overlapping or similar type. A control console, designated by the reference numeral 21, is of course provided for actuation of the entire machine.

Figure 2:
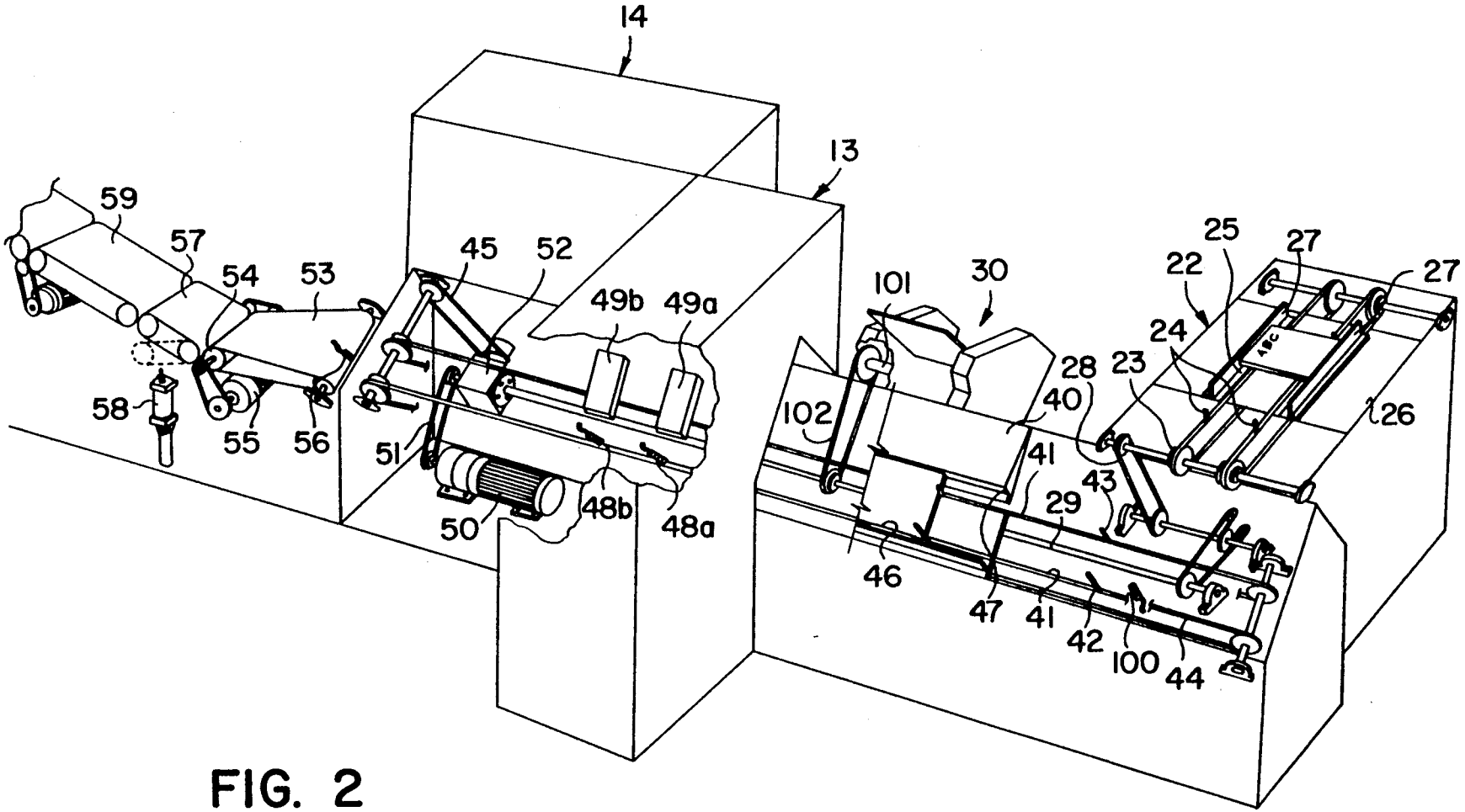
FIG. 2 is an enlarged perspective view of part of the machine of FIG. 1, with cutaway portions in order to illustrate more clearly the kinematic mechanisms and the individual components of the said machine.

FIG. 2, which shows an enlarged view of the front part of the machine of FIG. 1, comprises a first lateral feeding means designated in general by the reference numeral 22, in the direction of advance of the graphic and/or printing products, at an inlet end of the machine.

It consists of a chain conveyor 23 provided with pusher elements 24 sliding in channels 25 in an upper surface 26 thereof. Side-wall elements 27 are moreover provided on opposite sides of and to the exterior of the channels 25, inside which the products 12*a*, 12*b*, etc. fed manually one after the other on the surface 26 are slidably guided. The chain conveyor 23 is driven by a drive means, designated in general by the reference numeral 28, deriving, by means of associated gears and pulleys, shown but not provided with reference numerals, from a central driving shaft 29.

A second lateral feeding means, designated in general by the reference numeral 30, is of the rotary loader type and allows for automatic feeding of the products 12*a*, 12*b*, etc. one after the other, wherein the products form part of a stack disposed on an intermediate stacking surface 31 on the said feeder 30. This second feeding means or rotary loader 30, shown more clearly in FIGS. 4 to 6, consists of a supporting structure 32 to which is fixed the said stacking surface 31, a set of three belts 33 being disposed at right angles at the top and at the rear in correspondence therewith, at least one of these being necessary, the rotation thereof ensuring the correct transfer of the products 12*a*, 12*b*, etc. irrespective of the materials they are made of.

Rotary drums 34 are disposed below the stacking surface 31, the individual products 12*a*, 12*b*, etc. being deposited thereon after being removed one after the other by suction elements 35 which are rotated in synchronization with a cranked lever 36 which is located at the lower end of the belts 33 and which acts, like an oscillating support, as a means for stopping and containing the stacked products.

The rotary drums 34 are provided with gripper elements 37 of curved shape, ensuring that the gripper elements are always supported at the lateral surface of the product 12*a*, 12*b*, etc. irrespective of their thickness. A pair of lower and upper belts, 38 and 39 respectively, are further provided, associated with and rotating in synchronization with the rotary drums 34, said belts receiving in their interior the product advanced by the gripper elements 37, once it has been released and dropped by said gripper elements. The lower and upper belts, 38 and 39 respectively, therefore take the product on to a sliding surface 40 forming part of the receiving conveyor 11.

It is known that the said rotary loader 30 can receive bundles or stacks of products 12*a*, 12*b*, etc. of different types and that the cranked lever or oscillating support 36 is capable of keeping one product separate from the next, irrespective of their thickness. However, the cranked lever 36 is capable of returning to its position below the stack, and of lifting the latter, so that the product is removed from the stack and is fed into the machine. It is moreover known that movement and control of both a main shaft 101 bearing the rotary drums 34 and the various units associated with the rotary loader are effected by a drive means 102 driven by the central driving shaft 29. The receiving conveyor 11 consists of a sliding surface 40 which is disposed on the framework 10 inclined with respect to the horizontal, like the upper surface 26 described hereinbefore, at an angle that can vary between 10° and 90°, thereby ensuring dropping of the product 12*a*, 12*b*, etc. arriving from the lateral feeding means, if present.

The sliding surface 40 is provided with two parallel longitudinal channels 41 in which pusher elements 42 and 43 divided into two sets and of different sizes are slidably guided, said pusher elements being integrally connected in their lower parts to a second closed ring chain conveyor 44 extending longitudinally over the entire length of the sliding surface 40. This second chain conveyor 44 is also driven by a kinematic drive means, designated in general by the reference numeral 45, deriving from the central driving shaft 29.

A containing edge 46 is provided at the lower longitudinal end of the sliding surface 40 and supports and stops the products 12*a*, 12*b*, etc. both while they are received from the lateral feeding means 22, 30 and while they are transferred on to the said sliding surface 40 by the pushers 42 and 43 of the associated conveyor 44. Appropriate sensor means are moreover provided at the zones in which the lateral feeders 22, 30, which may be of any number, are disposed, said sensor means, one of which is designated by the reference numeral 100, verifying the presence of the product and coordinating the correct operative movement of the said lateral feeders and the chain conveyor 44 provided with the pusher elements 42, 43.

The sliding surface 40 is moreover provided with raised elements, such as steps 47, of different numbers (in FIG. 2 one single step and in FIGS. 4 and 5, two steps) which contribute to the correct positioning of the individual products 12*a*, 12*b*, etc. and to guiding them in their subsequent movement along the receiving conveyor 11.

In the example, the pushers 42 and 43 are in the form of pins, the pushers 42 projecting out further from the sliding surface 40 than the pushers 43. The pushers 43 must in fact be surpassed and must not create an obstacle to the lateral feeding of the products 12*a*, 12*b*, etc., this function and arrangement being illustrated more clearly in FIGS. 4 and 5.

Furthermore, these figures show raised elements or steps 47 which have a height almost equal to that of the pushers 43 in the immediate vicinity thereof, thereby further simplifying the feeding of the products and preventing any blocking.

As shown, a detector unit 13 is disposed along the sliding surface 40 of the receiving conveyor 11. This unit consists of sensor means for identifying each of the products, capable of recognizing images or codes or sizes or other information present on the graphic and/or printing products being handled, stored beforehand in the central computer 14 by an operator working on the control console 21.

In FIG. 2, the detector unit 13 consists of a pair of sensor elements 48*a* and 48*b* respectively coupled to a telecamera, shown in diagrammatic form at 49*a*, and a chromatic detector, shown in diagrammatic form at 49*b*, which determine the tipology of the product passing over the sliding surface 40 by means of the color, size, or the special presence of codes, etc.. These sensor means can of course be grouped together in one single element performing all of the abovementioned functions. A motor 50 controlling the rotation of the central driving shaft 29 by means of the interposition of a drive means 51 and a variator 52 is shown in the framework 10 at the end portion of the sliding surface 40.

The central computer 14 is connected by means of known lines (not shown) to the various units and to the various motorized parts so as to actuate them in accordance with an appropriate predetermined operating sequence.

An intermediate conveyor 53, referred to as a twist conveyor, is associated with the outlet end of the sliding surface 40 of the receiving conveyor 11, said intermediate conveyor being inclined and aligned with the end portion of the said sliding surface at one end, while at the other end it is disposed horizontally. This intermediate conveyor 53 consists, e.g. of a belt winding around end rollers 54, one of which is controlled in rotation by a motor 55 by means of an associated drive means. The motor 55 is controlled by a further sensor means 56 positioned at the inlet of the intermediate conveyor 53. Furthermore, this sensor means 56 selectively controls both the said unloading means and the said discharge means.

The unloading means 17 and 18 are disposed after the intermediate conveyor 53 and in FIG. 2 the lower front parts thereof are shown in diagrammatic form with a discharge conveyor having an oscillating belt 57, e.g. displaced between a position providing for continuity of the machine and a lowered discharge position by means of a cylinder 58.

Further fixed conveyor belts, designated in general by the reference numeral 59, are provided with associated motor variators 60 (FIG. 3) which define the end par of the machine according to this invention.

These end parts, also shown in diagrammatic form in FIG. 1, may in fact comprise a plurality of fixed conveyor belts 59 with associated oscillating belts 57 so as to define a series of outlets leading to an equal plurality of collecting conveyors. In this manner, it is clear that the oscillating belts 57 act as elements deflecting the individual products towards the respective collecting conveyors 19 and 20.

Figure 3:
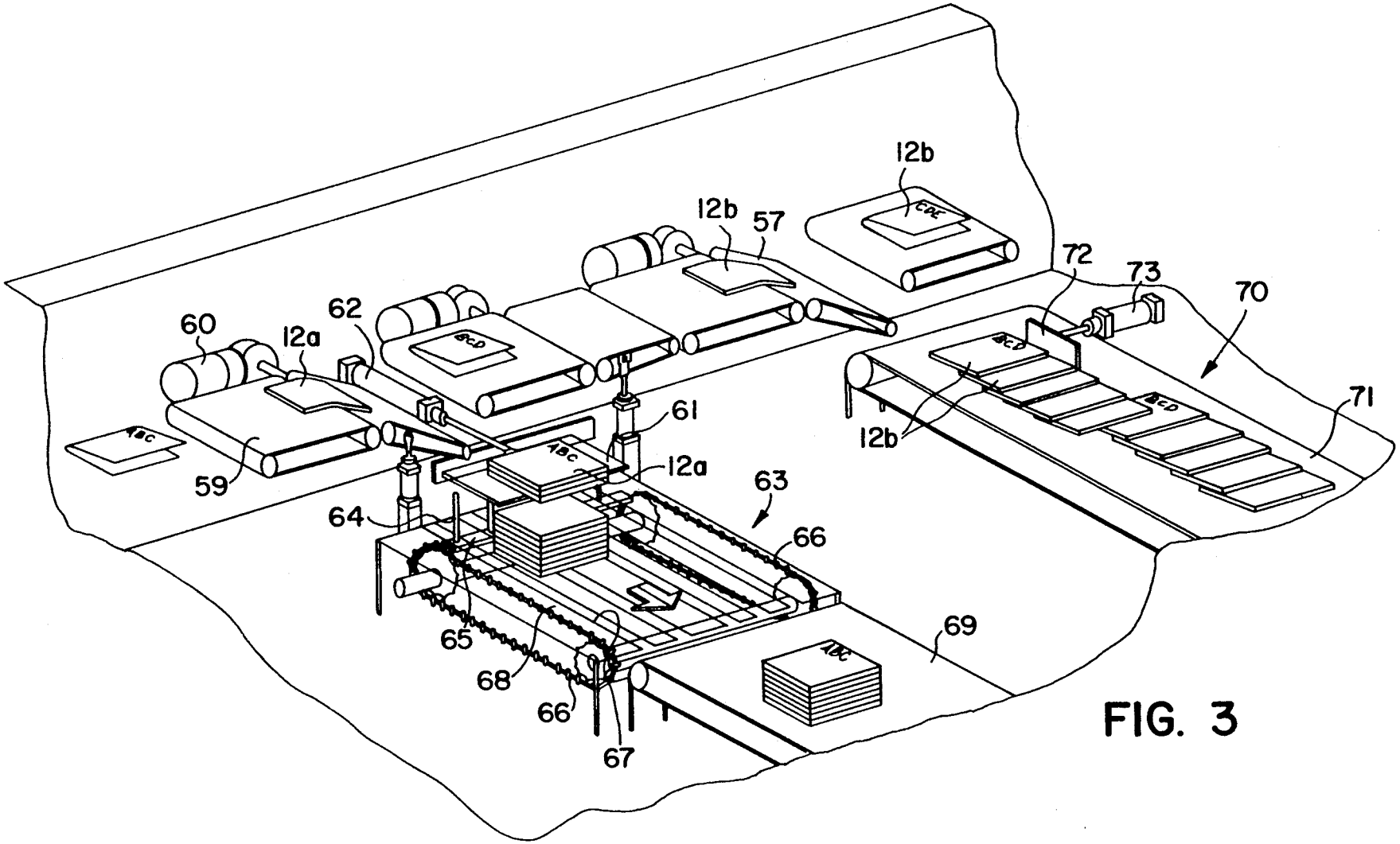
FIG. 3 is a diagrammatic perspective view of part of the machine in the end zone thereof for discharge and unloading of the products.

FIG. 3 in fact shows that a collecting surface 61, which can be translated by means of an associated actuator means 62, such as a cylinder, can be provided in correspondence with an oscillating belt 57, below said belt. The collecting surface 61 can in fact be translated between a position precisely below the oscillating belt 57 and a withdrawn position ensuring dropping of the products, e.g. 12*a*, on the initial portion of a collecting conveyor designated in general by the reference numeral 19.

The collecting conveyor 19 consists of sets of pushers 64 integrally connected to crosspieces 65 fixed to drive chains 66. The pushers 64 slide into channels 67 formed in an upper surface 68 of the collecting conveyor 19 and when inserted into respective channels provided in the collecting surface 61 (not shown) ensure dropping of the products 12*a* on the upper surface 68 of the said conveyor 19. The products are therefore advanced to a further conveyor belt designated by the reference numeral 69 for final delivery from the machine.

Alternatively, a second type of collecting conveyor designated in general by the reference numeral 20 can be provided in correspondence with another oscillating belt 57. This second type of conveyor may be a simple conveyor belt 71 having an associated surface plate or element 72, which can be displaced between positions transversely above the conveyor belt 71 by means of a cylinder 73. By virtue of an arrangement of this kind, or preferably a predetermined arrangement of the surface plate 72 for a certain number of products, e.g. 12*b*, it is possible to obtain a scaled and partially overlapping arrangement of the products.

Figure 6:
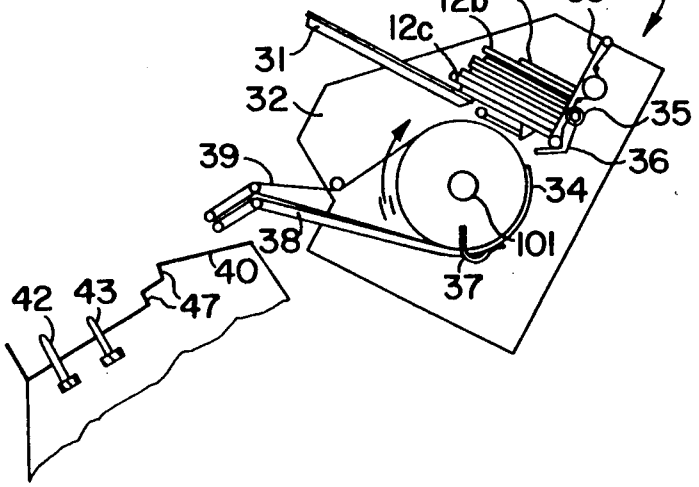
FIG. 6 is a section analogous to that of FIG. 5 in a different operating position.
Figure 5:
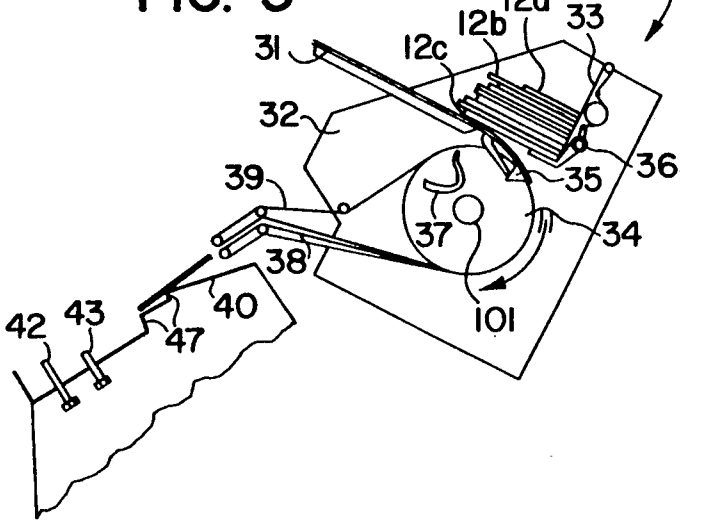
FIG. 5 is a first transverse section through the rotary loader applied to the machine.
Figure 4:
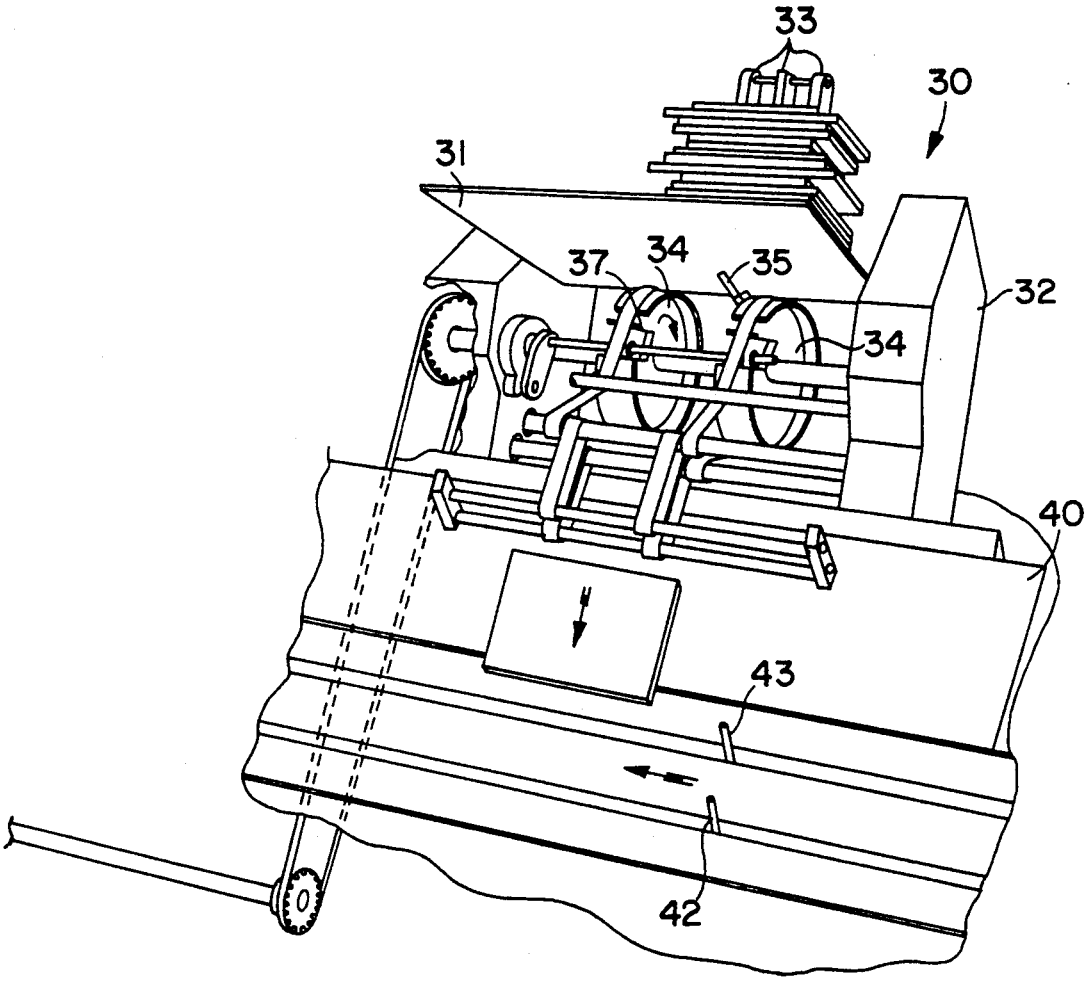
FIG. 4 is an enlarged perspective view of a rotary loader shown in FIG. 2.
Figures 7, 8, 9:
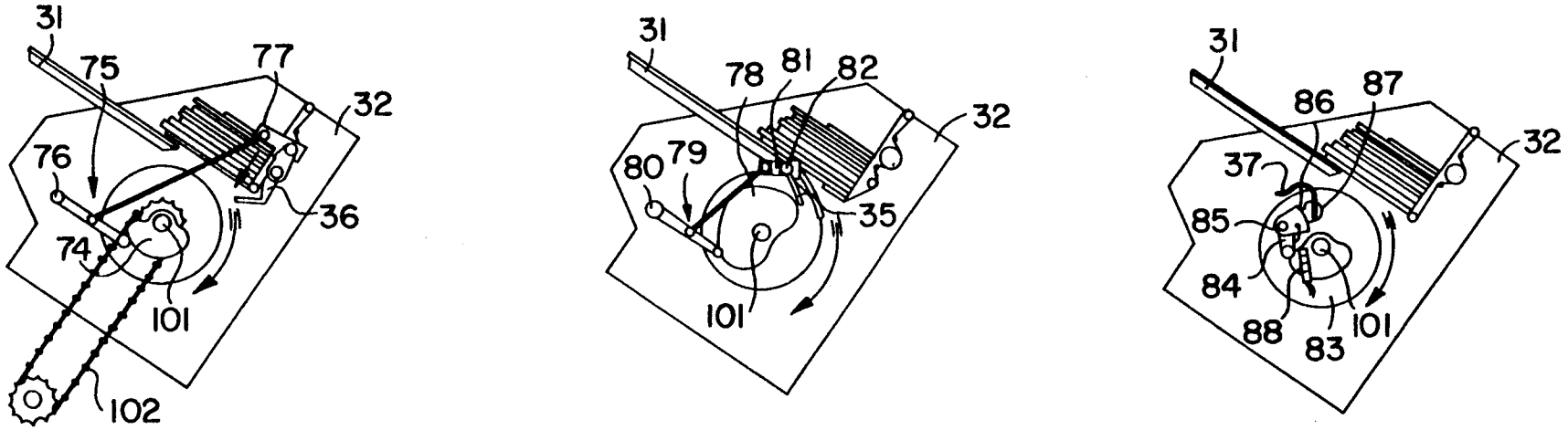
FIGS. 7, 8 and 9 are sectional views of construction details providing for the functions of the rotary loader of FIG. 4.

FIGS. 7 and 9 show how the various components constituting the rotary loader 30 are actuated, these not being described hereinbefore, but being deducible from FIGS. 4–6.

The drive means 102 and the main shaft 101 provide for the rotation of the drums 34 connected thereto. A set of cam elements providing for the displacement or rotation of the various elements for handling the products are also connected or fixed to this shaft. Firstly, pulleys (not shown) driven by the drive means 102, move the belts 33 step by step, a freely rotatable mechanism or a similar ratchet gear being provided for the correct displacement of the products 12*a*, 12*b*, etc. towards the stacking surface 31.

A first cam element 74, connected to the main shaft 101, provides for oscillation of an articulated lever 75 hinged at one side at 76 on to the supporting structure 32 and at the other side hinged at 77 on to the cranked lever 36, so that it is oscillated between its two operative positions described hereinbefore.

A second cam element 78, displaced in an appropriate manner with respect to the first cam element 74, provides for the rotation of a second articulated lever, designated in general by the reference numeral 79. This lever 79 is hinged at one side at 80 on to the supporting structure 32 and at the other side is hinged at 81 on to a supporting structure 82 for a plurality of the said suction elements 35, thereby promoting rotation of the latter and the selective holding of a front portion of a product 12*a*, 12*b*, etc.. In this manner, the initial portion of the said product is removed from the bottom of the stack disposed on the stacking surface 31 and translated towards the rotary drums 34.

When the said initial portion is arrived in this position, it is engaged by the gripper elements 37 disposed the rotary drums 34. The selective gripping movement of the said gripper elements 37 is effected by a third cam element 83, fixed to the supporting structure 32. The gripping movement of the gripper elements 37 is effected by means of a kinematic mechanism consisting of a cranked lever 84 hinged at 85 on to the rotary drums 34. The cranked lever cooperates at one side with the surface of the third cam element 83, while at the other side it is provided with a tooth formation 86 which meshes with a toothed gear 87, also hinged on to the rotary drum 34, thereby providing for the oscillation gripping movement of the gripper element 37 integral with the toothed gear 87. A return spring 88 is also provided and, acting between the drum 34 and the cranked lever 84, in each case ensures contact between the gripper elements 37 and the lateral surface of the drums and/or the interposed products.

As stated hereinbefore, by virtue of the special shape of the gripper elements 37, which may be of variable number on the rotary drums 34, and the correlation of the movements with the other elements constituting the rotary loader, it is possible to handle products 12*a*, 12*b*, etc. of any desired thickness and of variable rigidity.

A machine for sorting graphic and/or printing products according to this invention is particularly advantageous in that it solves the technical problem of having to receive the products of this kind in bundles or stacks and then having to sort the various products into the different types constituting the bundles and at the same time having to count and sort the products recognized or preferably determined in an appropriate manner according to predetermined sequences.

A detailed description of the operation of the machine is almost unnecessary as this can be seen clearly from the drawings and from the preceding description.

To summarize, the bundles or stacks of different and/or mixed products are either fed manually to the sliding surface or are fed by means of one of the lateral feeding means 22 or 30. In this case, there can be coordinated feeding among the various feeders, as the sensors 100 ensure the correct actuation thereof. They moreover provide for the appropriate speed of the receiving conveyor 11.

The products 12*a*, 12*b*, etc., having arrived on the sliding surface 40, are passed under the identifying sensor means 48*a*, 48*b*, 49*a*, 49*b* which cooperate with the central computer 14 and classify, identify and count the various different graphic and/or printing products. According to this classification or sorting and according to the commands entered into the computer 14 beforehand by the operator via the control console 21, the products are then discharged, collected in new predetermined homogeneous stacks, e.g. by title, by publisher or by some other classification, and diverted to selected outlets.

The special structure of the machine allows for reliable complete handling of the products which may be mixed and of different sizes, solving the technical problem known in the prior art. Above all, a machine according to the invention is advantageous for handling what are referred to as returns, where there is required typological, dimensional and numerical control of the graphic and/or printing products returned to the source, also in accordance with immediate sending and dispatching of further quantities of the product, e.g. in the case of daily newspapers.

It can be seen therefore that, provided that they are correlated and controlled in an appropriate manner, many different types of feeding means can be associated with a machine according to the invention.

We claim:

1. Machine for sorting graphic and/or printing products which the said products are fed one after the other, comprising a framework, a conveyor means for receiving individual products one after the other, sensor means for identifying each of the said products on the said receiving conveyor means, a central computer, a control console for the entry of predetermined data, selectively actuated intermediate conveyor belt means for unloading the said products from the said receiving conveyor means and at least one discharge conveyor for discharging the said unloaded products, characterized in that the said receiving conveyor means consists of a sliding surface and is disposed on the said framework inclined at an angle of between 10° and 20° relative to the horizontal plane, that the said sliding surface has a lower end edge for containing the said products and is provided with at least one longitudinal channel in which pusher elements are slidably guided, said selectively actuated intermediate belt conveyor means being associated with an end portion of the said receiving conveyor means, said selectively actuated intermediate belt conveyor means being inclined and aligned with the receiving conveyor means at one end and at the other end being horizontal and aligned with the said discharge conveyor, said discharge conveyor further comprising deflector elements wherein at least two collecting conveyors are moreover associated with the said discharge conveyor and are operatively and selectively connected thereto by means of said deflector elements, also actuated selectively in accordance with a predetermined sequence controlled by the said computer.

2. Machine according to claim 1, characterized in that the said sliding surface is provided with at least one adjacent longitudinal raised element which is parallel to the direction of movement of the said products on the receiving conveyor and is higher than both said at least one channel and said lower containing edge.

3. Machine according to claim 2, characterized in that the said at least one longitudinal raised element is a longitudinal step having at one side a wall perpendicular to the sliding surface and parallel to the said containing edge.

4. Machine according to claim 1, characterized in that two parallel longitudinal channels are provided in the said sliding surface and that the said pusher elements are two sets slidably guided in the said channels, the pusher elements of one set closer to the said lower containing edge projecting out further from the said sliding surface than the other set closer to the interior of the said surface and projecting out to a lesser extent.

5. Machine according to claim 4, characterized in that the said pusher elements projecting out to a lesser extent than the other set have a height almost equal to that of at least one longitudinal raised element parallel to the said lower containing edge.

6. Machine according to claim 1, characterized in that the said deflector elements consist of oscillating conveyor belts which are oscillated by means of associated actuating cylinders integral with the said framework.

7. Machine according to claim 1, characterized in that the said collecting conveyors consist of a set of pushers, integral with crosspieces fixed to drive chains, and an upper surface provided with channels for the sliding of the said pushers, a collecting surface moreover being provided, disposed below one of said deflector elements and on an initial portion of the said collecting conveyors.

8. Machine according to claim 1, characterized in that the said collecting conveyors are simple conveyor belts, disposed below the said deflector elements, with which is associated at least one surface element which are displaced transversely relative to the said simple conveyor belts, providing for a stepped arrangement of the said products.

9. Machine according to claim 1, characterized in that a sensor means for feeding the selective control of both the said intermediate conveyor and the said discharge conveyor is associated with the said intermediate conveyor.

10. Machine according to claim 1, characterized in that at least one lateral feeding means for feeding an individual product on the said sliding surface is associated with an inlet end of the said receiving conveyor.

11. Machine according to claim 10, characterized in that the said lateral feeding means is a conveyor having pusher elements disposed essentially horizontally and perpendicular to the direction of movement of the said receiving conveyor means and that the said transverse feeding means are driven in phases by a centralized drive means.

12. Machine according to claim 10, characterized in that the said lateral feeding means is a rotary loader.

13. Machine according to claim 12, characterized in that the said rotary loader consists of a supporting structure provided with an intermediate stacking surface, at least one belt disposed at right angles at the top and to the rear with respect to the said stacking surface, a pair of rotary drums integrally connected to a rotatable driving shaft mounted on the said supporting structure and controlled by an associated motor means, lower and upper belts being associated with the said rotary drums for conveying the products to said sliding surface, an oscillating support disposed below the said stacking surface, gripper elements located on the said rotary drums for gripping the said products and suction elements for removing an individual product from the bottom of the said stack and advancing it towards the said gripper elements, and phase control means for the said elements.

14. Machine according to claim 13, characterized in that the said phase control means are cam elements interacting, by means of articulated levers, respectively with the said oscillating support, the said gripper elements and the said suction elements.

15. Machine according to claim 14, characterized in that a first of the said cam elements is connected to the said driving shaft, a rotatable roller carried by a first articulated lever hinged at one side on to the said supporting structure and at the other side hinged on to the said oscillating support interacting with the lateral surface of said oscillating support.

16. Machine according to claim 14, characterized in that a second of the said cam elements is connected to the said driving shaft, an associated rotatable roller carried by a second articulated lever hinged at one side on to the said supporting structure and at the other side hinged on to a supporting structure for the said suction elements interacting with the lateral surface thereof.

17. Machine according to claim 14, characterized in that a third of the said cam elements are rigidly fixed with respect to the said supporting structure and at its lateral surface interacts with rotatable rollers carried at the end of cranked levers, hinged on to each of the said rotary drums having toothed ends and each interacting at one of their toothed ends with toothed gears, rotatably mounted on the said rotary drum and each carrying one of the said gripper elements.

18. Machine according to claim 17, characterized in that the said third cam element interacts by means of the said cranked levers, with a shaft rotatably and integrally mounted on the said drums and an elastic return element interposed between each of the said cranked levers and the said rotary drums.

19. Machine according to claim 13, characterized in that the said at least one belt is moved step by step, a freely rotatable mechanism or a ratchet gear, operatively controlled by the oscillation of the said oscillating support.

* * * * *